US011034542B2

(12) United States Patent
Troxler

(10) Patent No.: US 11,034,542 B2
(45) Date of Patent: Jun. 15, 2021

(54) APPARATUS AND METHOD FOR THE OPTIONAL CROSS-FOLDING OF SEQUENTIALLY PRINTED SHEETS OR SIGNATURES

(71) Applicant: MÜLLER MARTINI HOLDING AG, Hergiswil (CH)

(72) Inventor: Christian Troxler, Rain (CH)

(73) Assignee: MÜLLER MARTINI HOLDING AG, Hergiswil (CH)

( * ) Notice: Subject to any disclaimer, the term of this patent is extended or adjusted under 35 U.S.C. 154(b) by 161 days.

(21) Appl. No.: 16/509,186

(22) Filed: Jul. 11, 2019

(65) Prior Publication Data

US 2020/0024097 A1 Jan. 23, 2020

(30) Foreign Application Priority Data

Jul. 17, 2018 (CH) ..... 00880/18

(51) Int. Cl.
*B65H 45/28* (2006.01)
*B65H 37/04* (2006.01)

(52) U.S. Cl.
CPC ..... *B65H 45/28* (2013.01); *B65H 37/04* (2013.01)

(58) Field of Classification Search
CPC .... B65H 2301/4454; B65H 2301/4455; B65H 2301/164; B65H 45/14; B65H 29/24; B41F 13/60
See application file for complete search history.

(56) References Cited

U.S. PATENT DOCUMENTS 4,917,662 A * 4/1990 Gombault ..... B65H 45/14 493/416
2007/0135288 A1 6/2007 Matsumoto
(Continued)

FOREIGN PATENT DOCUMENTS

EP 2727868 A1 5/2014
EP 2727869 A1 5/2014
(Continued)

OTHER PUBLICATIONS

International Search Report for Swiss Patent Application No. 8802018 dated Oct. 22, 2018.

*Primary Examiner* — Jennifer E Simmons
(74) *Attorney, Agent, or Firm* — FisherBroyles, LLP; Robert Kinberg

(57) ABSTRACT

An apparatus and method for optional cross-folding of successively following, sequentially printed sheets on a first transport segment. A compressed air device comprises a first control element that is connected to a control unit for triggering or suppressing a compressed air blast from at least one exit opening in the compressed air device. A printed sheet is diverted into a second transport segment for the folding operation or a third transport segment for bypassing the folding operation. The latter empties downstream of folding rolls into the second transport segment at a joint segment point, at which a fourth transport segment adjoins in downstream direction. The third transport segment is longer than the second transport segment or can be operated at a lower speed than the second transport segment such that a first sequence of printed sheets successively following on the first transport segment is identical to a second sequence of the successively following printed sheets located on the fourth transport segment.

20 Claims, 8 Drawing Sheets

(56) References Cited

U.S. PATENT DOCUMENTS

| | | | | |
|---|---|---|---|---|
| 2014/0121093 | A1* | 5/2014 | Braschoss | B65H 45/04 493/454 |
| 2015/0321871 | A1* | 11/2015 | Nakagawa | B65H 5/26 493/443 |
| 2019/0284012 | A1* | 9/2019 | Yoneyama | B65H 29/145 |

FOREIGN PATENT DOCUMENTS

| | | | |
|---|---|---|---|
| EP | 2818331 | A2 | 12/2014 |
| IE | 102016203043 | A | 8/2017 |

* cited by examiner

APPARATUS AND METHOD FOR THE OPTIONAL CROSS-FOLDING OF SEQUENTIALLY PRINTED SHEETS OR SIGNATURES

CROSS-REFERENCE TO RELATED APPLICATIONS

This application claims the benefit of the Swiss Patent Application No. 00880/18, filed on Jul. 17, 2018, the disclosure of which is incorporated herein by reference in its entirety.

BACKGROUND OF THE INVENTION

The invention relates to an apparatus and a method for an optional cross-folding of successively following, sequentially printed sheets or signatures. Optional cross-folding here means that the printed sheets to be processed successively are either cross-folded or not folded at all. The apparatus comprises a first transport section on which the individual printed, first printed sheets to be cross-folded and second printed sheets not to be folded, are transported successively in a guide plane, and are respectively made available in a folding position. The apparatus furthermore comprises at least two folding rolls, arranged on a first side of the guide plane and respectively provided with a rotational axis, which form between them a folding gap for first printed sheets to be cross-folded, wherein the rotational axes are oriented essentially parallel to each other and parallel to the guide plane. The apparatus is furthermore provided with a compressed air device, arranged on a second side of the guide plane that is positioned opposite the first side of the guide plane, in the region of the folding gap, which device is essentially oriented parallel to the rotational axes of the folding rolls. The compressed air device is connected to a compressed-air source and to a control unit and comprises at least one exit opening for focusing compressed air onto the folding gap. Finally, the apparatus also comprises a second transport segment for cross-folded first printed sheets and a third transport segment for non-folded, second printed sheets. The first, second and third transport segments have a joint first segment point where the first transport segment ends and the second and third transport segments start. The joint first segment point is located on a line of intersection between the guide plane and a folding plane passing through the folding gap and at least one exit opening for the compressed-air device.

During the operation, at least one first and one second printed sheet are successively conveyed in a guide plane of a first transport segment and are made available in a folding position. On a first side of the guide plane the first printed sheet made available is folded along a folding line in a folding gap between at least two folding rolls, respectively provided with one rotational axis. A compressed air blast coming from the at least one exit opening of the compressed air device that is connected to a compressed air source and a control unit is triggered from a second side of the guide plane, located opposite the first side, which compressed air blast is focused in the region of the folding gap onto the first printed sheet made available in the folding position. Following the compressed air blast, the available first printed sheet is then transported out of the guide plane and onto a second transport segment to be moved to the rotating folding rolls and, following the cross folding, is transported further on this second transport segment. A compressed air blast onto the second printed sheet that is not folded and is available in the folding position is suppressed, so that it can be guided onto a third transport segment.

The sequentially printed sheets can either be non-folded or longitudinally folded printed sheets which are supplied inline, meaning directly or indirectly following a digital printing press. Alternatively, the feeding can also occur offline, meaning starting from an intermediate, sequentially printed material web, from which printed sheets are subsequently cut and then longitudinally folded, if applicable, or also from a buffer storage containing non-folded or longitudinally folded printed sheets.

For the digital printing, the print image is transferred directly from a computer to the printing press, without the use of static print forms. In the process, the material web can be printed in dependence on the predetermined folding pattern in the specified sequence for the finished printed product, meaning sequentially. In this way, even relatively small piece numbers up to a single printed product can be realized. In contrast to traditional printing methods, for example the offset printing, successively following printed sheets here frequently have different characteristics, such as the print itself, the number of printed pages per printed sheet, and its respective format.

Finally, digital printing presses nowadays print larger and larger amounts of print material per time unit. Regardless or whether the digital printing presses process material webs or individual printed sheets, these large amounts of printed material must subsequently be processed further. The high material throughput can result in high transporting speeds, which make a careful further processing more difficult. Depending on the machines used for the post-processing, gaps must be formed between the printed sheets, thus further increasing the transporting speed. Blank pages in a printed product are furthermore accepted less and less these days because of the technical potential of the digital printing process.

Known from the EP 2727868 A1 and the EP 2727869 A1 are respectively an apparatus and a method for the longitudinal and cross folding of sequentially printed sheets with a digital printing press. For this, the apparatus is provided with a compressed air device connected to a compressed source and a control unit and has at least one exit opening for the compressed air. A blast of air from the compressed air device which moves the printed sheets from a feeding plane to between the folding rolls can thus be metered easily and quickly, corresponding to the current characteristics of a printed sheet to be folded, thus making it possible to a achieve good folding quality as well as a high folding capacity over the total spectrum of sheets to be folded. If a printed sheet does not meet quality requirements, the compressed air blast can optionally be suppressed. As a result, this printed sheet is not supplied to the folding rolls, is consequently not folded, and is conveyed out via a separate conveying path.

With an apparatus of this type and using a sheet cut in the meantime from the material web, or also a sheet processed individually in the digital printing press, the transport speed can be reduced through a single or multiple cross folding operation. The gap resulting from the cross folding between two successively following printed sheets, can be reduced for this. The gap is increased as a result of conveying out defective printed sheets.

Said apparatus therefore only permits creating a product flow of folded printed sheets. To be sure, the cross-folding permits a careful further processing of the printed sheets, but potentially also results in an undesirably higher number of blank pages with the same number of folding operations. In contrast, it is known that the number of blank pages in a printed product can be reduced through the integration of non-folded printed sheets. However, the non-folded printed sheets cannot be integrated into the product flow with the known apparatus or the known method. The use of non-folded printed sheets furthermore results in a cycle increase, which can lead to a high transporting speed, depending on the post-processing machines which, in turn, can make a careful further processing more difficult as well as lead to quality problems.

The EP 2818331 A2 discloses an apparatus and a method for the post-processing of a paper web, sequentially printed in a digital printing press. The printed paper web initially passes through a perforating and cutting station. The printed sheets cut off therein are each folded individually one time or several times. Following the folding operation, the printed sheets which later on form a partial book block are gathered in an overlapping flow in a gathering device before they are stacked and provided with adhesive in a subsequent stacking device to form a partial book block. The partial book blocks are then transported to further processing stations. To reduce the number of blank pages, the folded printed sheets can also be combined with a non-folded printed sheet. However, this non-folded printed sheet must always be applied at the end of a printed product to be formed, meaning after the folded printed sheets. The pocket folding device generally used for this requires a gap for operating a mechanical flap between a folded and a non-folded sheet, which guides a single printed sheet without folding through the folding rolls instead of into the folding pocket for the folding operation. The switching of this flap respectively requires a specific time, meaning a corresponding gap based on the transport speed. A gap of this type can be generated, for example, with a stop-and-go operation. This gap is larger the higher the transport speed and the smaller the cutting length of the printed sheets and, consequently, the higher the number of cycles. To be sure, the time required for switching the flap can be minimized through using modern drive technology, but it cannot be eliminated.

A certain reduction in the number of blank pages can be achieved with this type of solution because of an automatically occurring optimizing of folding patterns, based on the use number, which corresponds to the respective production orders. However, the space and control expenditures are relatively high because of the number of processing stations needed. Depending on the mode of operation, the transport speed following the cutting is furthermore relatively high for the printed sheets to be conveyed individually and successively at a short distance to each other through the apparatus, so that quality problems can occur during the post-processing. The paper web is furthermore stopped briefly in a cross cutter, arranged upstream of the pocket folder used for the cross folding, thus leading to a discontinuous operation as well as the use of a relatively expensive, upstream-arranged storage segment. Finally, the transport path is only cleared if the preceding printed sheet has been conveyed out of the pocket folder following the folding operation.

A gap can alternatively also be formed by increasing the transport speed of the preceding printed sheets and/or the following units, or by slowing down the material web to be fed in. However, with the known folding machines using pocket folders, an increase in the transport speeds to form the gap for the post-processing operations has physical limitations, which negatively affect the output, so that these folding machines are rather unsuitable for processing high piece numbers. In general, an acceleration or delay can result in print quality problems as compared to the use of a constant speed.

A folding machine is known from the DE 10 2016 203 043 A1 to which the printed sheets are supplied in an overlapping flow in order to increase the capacity, thus making it possible to reduce the transport speed or to increase the number of printed sheets transported at the same speed. This also results in a more flexible solution which, in the final analysis, is strongly limited when processing a large number of printed sheets per time unit. Owing to the above-mentioned dependence, this method is also not suitable for the dynamic processing of individual printed sheets. The required spacing between folding rolls, which differs depending on whether the printed sheets are supplied individually or in an overlapping flow, would furthermore have to be changed with high dynamic which makes it even more difficult to control the process.

SUMMARY OF THE INVENTION

It is therefore an object of the invention to create a flexible apparatus and a corresponding method which allow the production of a printed product composed of cross-folded first printed sheets and non-folded second printed sheets. The apparatus and the method should permit an easy and cost-effective adaptation to changed characteristics of successively following printed sheets, along with high folding quality and capacity, and should therefore also be suitable for the post-processing of sequentially printed sheets with digital printing machines. It should also be possible to achieve a potential reduction in the number of blank pages in the finished printed product.

With an apparatus according to the invention for the optional cross folding of successively following, sequentially printed sheets, the above and other objects are solved, according to an embodiment by providing the compressed air device with a first control element, connected to the control unit, for optionally triggering or suppressing a compressed air blast from the at least one exit opening in the compressed air device, such that starting with the folding position, respectively a first printed sheet can be moved into the second transport segment for the cross-folding operation, or a second printed sheet to the third transport segment for bypassing the cross folder. Downstream of the folding rolls, the third transport segment and the second transport segment meet at a joint second segment point. A fourth transport segment furthermore adjoins downstream of the joint second segment point. In addition, the third transport segment is embodied longer than the second transport segment or can be operated slower than the second transport segment, such that a first sequence of printed sheets successively following on the first transport segment is the same as a second sequence of successively following printed sheets on the fourth transport segment.

With the method according to the invention, the above and other objects are solved in that the non-folded second printed sheet that is moved to the third transport segment is conveyed for a longer period than the folded first printed sheet conveyed on the second transport segment, and that following the first, folded printed sheet, the non-folded, second printed sheet is then guided into a fourth transport segment adjoining the second transport segment, so as to reestablish the sequence for the successively following printed sheets on the first transport segment.

With an apparatus of this type and the corresponding method, sequentially printed sheets from digital printing presses can optionally be processed further either folded or non-folded, thus allowing the production of a printed product consisting of cross-folded first and non-folded second printed sheets and also a reduction in the number of blank pages in the finished printed product. While maintaining and/or recreating the original sequence, the non-folded second printed sheet can be inserted into the gap created through bypassing the cross-folding station, following the cross-folded sheet and at a distance thereto. In addition to triggering or suppressing a compressed air blast, the first control element can also change the duration during which a printed sheet, made available in the folding position, is admitted with compressed air. Since the printed sheets can be supplied to the apparatus nearly continuously, no or almost no increase in the transport speed is advantageously necessary.

According to one embodiment of the inventive apparatus, the third transport segment is essentially embodied longer than the second transport segment by half the length of a first printed sheet to be cross folded. The non-folded second printed sheet can thus be inserted at a defined position following the folded first printed sheet and advantageously also between two cross-folded first printed sheets. No abrupt or substantial speed changes therefore occur for the printed sheets, thus making it possible to avoid influences reducing the processing stability and/or quality of the printed sheets.

According to a different embodiment of the inventive apparatus, the third transport segment is provided in the region of the third transport segment with a device for adjusting its length. According to a corresponding embodiment of the inventive method, the length of the third transport segment is changed to match a following processing order with printed sheets having a different format as compared to the previous order. As a result, the apparatus as well as the method can be adapted advantageously to different printed sheet lengths for successively following processing orders.

A different embodiment of the inventive apparatus is provided in the region of the first transport segment with a light barrier and/or an image-detecting device, connected to the control unit, for automatically detecting a front edge of a printed sheet being transported in the first transport segment. According to a corresponding embodiment of the inventive method, a front edge of a printed sheet transported on the first transport segment is automatically detected. Based thereon, a corresponding information is sent to the control unit. The control unit generates a corresponding pulse for the instant of time of an optionally triggering or suppressing a compressed air blast from the at least one exit opening of the compressed air device onto the printed sheets, moved in the meantime to the folding position, and further transmits this pulse to a first control element connected to the compressed air source and the compressed air device. As a result of arranging the light barrier and/or the imaging device in the region of the first transport segment and thus just prior to the compressed air device, the instant of time of triggering or suppressing of the compressed air blast can advantageously be controlled precisely. The decision, whether such a compressed air blast is triggered or suppressed, depends on the production orders that are deposited within the control unit. In case there is an image-detecting device, arranged additionally or alternatively to the light barrier, the printed sheets can be identified advantageously and definitely by means of respective identification features, immediately before the cross-folding device.

According to another embodiment of the inventive apparatus, a first diverter is arranged in the second transport segment and a first receiving container is arranged downstream of the first diverter. According to a corresponding embodiment of the inventive method, the first printed sheet is conveyed out of the second transport segment for control purposes. The operator can therefore remove for control purposes at any time a folded, first printed sheet positioned on the second transport segment.

According to a different embodiment of the inventive apparatus, the folding rolls are arranged above and the compressed air device below the guide plane. The removal by the machine operator for control purposes of a first printed sheet, positioned on the second transport segment, can thus occur at an ergonomically favorable operating level.

A different embodiment of the inventive apparatus is provided in the fourth transport segment, provided with a second diverter and downstream of the second diverter with a second receiving container for printed sheets. According to a corresponding embodiment of the inventive method, faulty first and/or second printed sheets are conveyed out of the fourth transport segment. In this way, even non-printed sheets at the start or end of an order can be removed.

According to one embodiment of the inventive apparatus, the first, the second, the third and the fourth transport segments have a joint drive that is connected to the control unit. No additional control expenditure is required for the necessary sensor technology and monitoring devices, thus resulting in a cost-effective solution. Owing to the joint drive, the printed sheets are not additionally accelerated and delayed, so that corresponding quality-reducing effects can be avoided.

Corresponding to a different embodiment of the inventive apparatus, a fifth transport segment starts downstream of the fourth transport segment, at a distance thereto, which has a separate drive connected to the control unit that allows operating the fifth transport segment at a different speed and especially at a lower speed than the fourth transport segment. According to a corresponding embodiment of the inventive method, the printed sheets are transferred downstream of the fourth transport segment to a fifth transport segment, operated separately from and arranged at a distance to the fourth transport segment, on which the printed sheets are conveyed with a different and in particular a slower speed than on the fourth transport segment. Owing to the speed difference between the fourth transport segment and the fifth transport segment, the latter can advantageously be adapted to the requirements of the following post-processing. If the fifth transport segment is operated at a slower speed than the fourth transport segment, the gaps developing in the apparatus between successively following printed sheets can be minimized to the desired size.

The fourth and/or the fifth transport segment of a different embodiment of the inventive apparatus is provided with a control member for adjusting the spacing between these two transport segments. According to a corresponding embodiment of the inventive method, the spacing between the fourth and fifth transport segments is changed accordingly for a following production order where at least one printed sheet has a different format as compared to the printed sheets of the previous order. When using an apparatus embodied in this way and/or the corresponding method, it is possible to adapt to successively following production orders with differently long printed sheets. A printed sheet of a following production order, having a larger format and located at the transition between the fourth and the fifth transport segment, therefore does not simultaneously get jammed in between both transport segments and get bunched up, crumpled, or even destroyed. A secure takeover of a smaller-format printed sheet of a following production order, located at the transition from the fourth to the fifth transport segment, should also be possible.

A different embodiment of the inventive apparatus comprises at least one additional control element, connected to the compressed-air source and the control unit, for changing a cross-sectional surface of the at least one exit opening in the compressed-air device and/or for changing a pressure of the compressed air supplied to this exit opening. By correspondingly admitting at least one of the two additional control elements, the compressed air blast from the compressed air device can be metered quickly and easily to correspond to the characteristics of a first printed sheet to be cross folded at present, so as to achieve a high folding capacity and good folding quality over the complete spectrum of first printed sheets to be folded.

Another embodiment of the inventive method provides for generating a first partial gap in the second transport segment, upstream of a folded first printed sheet, during the further conveying of a non-folded second printed sheet to the third transport segment. During the folding of another first printed sheet belonging to the same production order, a second partial gap is created downstream of this additional first printed sheet and adjacent to the first partial gap. Both partial gaps jointly form a gap for inserting in the region of the fourth transport segment the non-folded second printed sheet, conveyed on the third transport segment, between the folded first printed sheets. An insertion gap is thus easily created in the second transport segment which is subsequently utilized for inserting in the region of the fourth transport segment, between the two folded first printed sheets, the non-folded second printed sheet that belongs to the same production order, which bypasses the folding rolls and is conveyed on the third transport segment.

According to a different embodiment of the inventive method, a first printed sheet having a first sheet length, a second printed sheet having a second sheet length, and another first printed sheet having a first sheet length are successively made available in the folding position, wherein for the same production order, the first printed sheet is essentially twice as long as the second printed sheet. In this way, it is ensured that the first printed sheets essentially have the same sheet length after the folding as the associated, non-folded second printed sheet, so that the latter can be inserted without problem into the gap between two successively following, first printed sheets.

BRIEF DESCRIPTION OF THE DRAWINGS

The invention is described further in the following with the aid of exemplary embodiments, showing in.

DETAILED DESCRIPTION OF THE INVENTION

Figure 1:
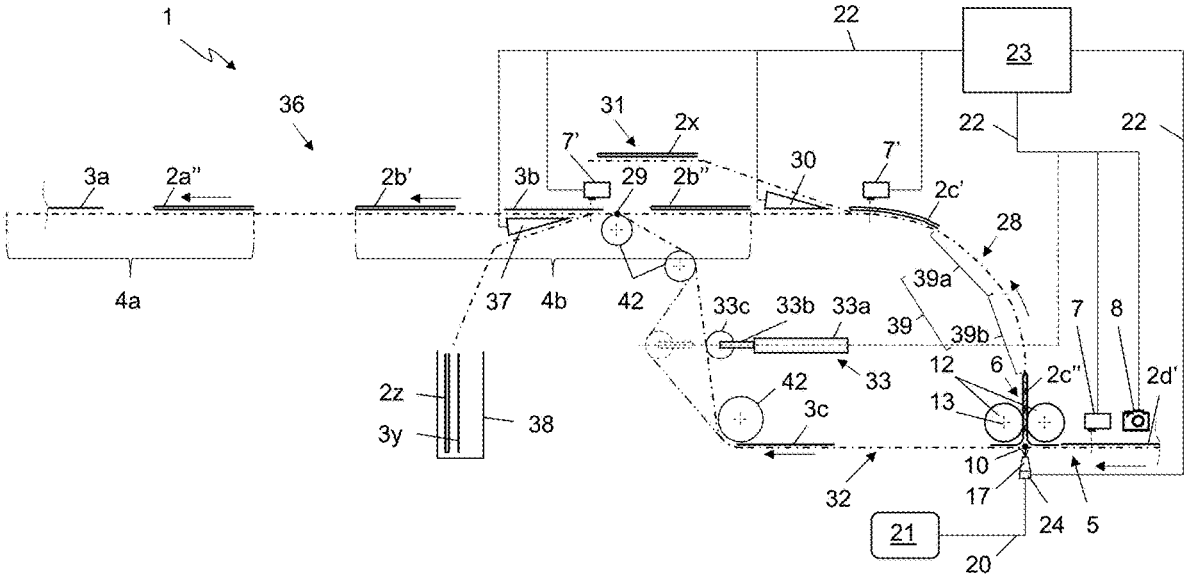
FIG. 1 A schematic view from the side of a first embodiment of an inventive apparatus for the optional cross-folding of successively following, sequentially printed sheets.

FIG. 1 shows in a schematic view from the side a first embodiment of an inventive apparatus 1 for the optional cross-folding of printed sheets 2, 3, in this case the depicted sheets 3*a*, 2*a*", 2*b*', 3*b*, 2*b*", 2*c*', 3*c*, 2*c*", 2*d*', previously printed sequentially by a digital printing press, which can respectively be combined downstream of the apparatus 1 into partial book blocks 4*a*, 4*b*, 4*c*, 4*d* etc. that are indicated by a curved bracket in the various Figures. According to the representation, first printed sheets 2*a*", 2*b*', 2*b*", 2*c*' have already been folded in the apparatus 1 while a following first printed sheet 2*c*" is in the process of being folded and another first printed sheet 2*d*' must be folded during a following process step. Second printed sheets 3, for example the sheets 3*a*, 3*b*, 3*c*, are transported without being folded through the apparatus 1. The printed sheets 3*a*, 2*a*" as well as a preceding, non-depicted printed sheet 2*a*' are intended for the later forming of the first partial book block 4*a*, the printed sheets 2*b*', 3*b*, 2*b*" are intended for producing the second partial book block 4*b*, and the printed sheets 2*c*', 3*c*, 2*c*" are intended for producing a third partial book block 4*c*, which is also indicated by curved bracket in FIGS. 7 and 8. Furthermore shown are printed sheets 2, 3 which have already been removed from the apparatus 1 for control purposes or because they are defective, here the printed sheets 2*x*, 3*y* and 2*z*. Even though respectively three printed sheets are intended for forming a partial book block in this representation, a different number of printed sheets can also be used. Instead of removing a single printed sheet 2, 3, a different number of printed sheets can furthermore also be removed successively.

Located upstream of the inventive apparatus 1 is a cutting and perforating unit, which is also not shown herein. Adjoining the cutting and perforating unit is a first transport segment 5 for the apparatus 1, which is connected to a cross-folding device 6 of the apparatus 1. At least on light barrier 7 and/or an image-detecting device 8 is arranged in the region of the first transport segment 5, directly in front of the cross-folding device 6.

Figure 2:
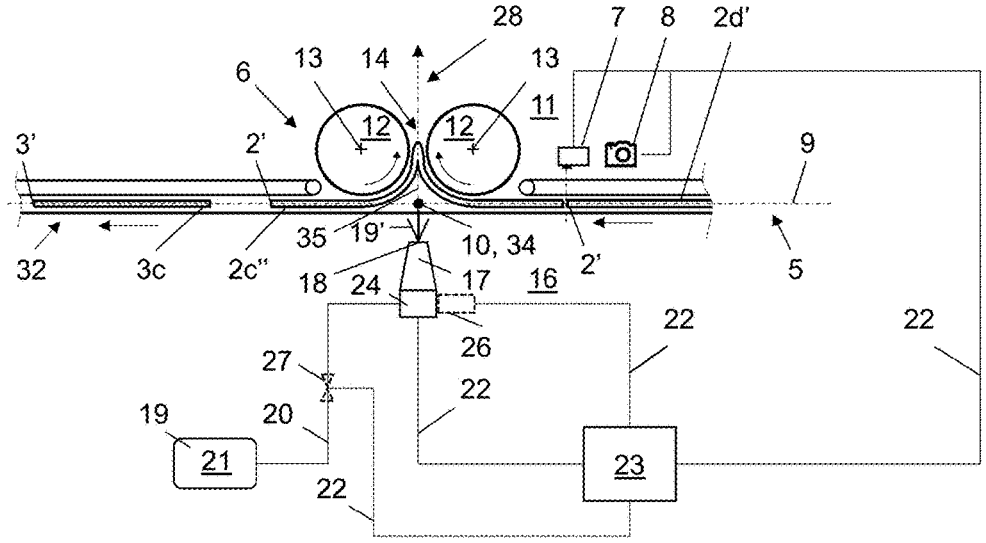
FIG. 2 An enlarged schematic representation of a cross-folding device for the inventive apparatus, shown at a somewhat earlier point in time than the instant shown in FIG. 1.

In contrast to FIG. 1, FIG. 2 shows an enlarged schematic representation of the cross-folding device 6 for the inventive apparatus 1, depicting the start of the folding of the first printed sheet 2*c*". The first transport segment 5 comprises a guide plane 9 in which respectively a following printed sheet 2, 3 is supplied, here the following first printed sheet 2*d*' to be cross folded. The transport plane ends in the cross-folding device 6, at a first segment point 10, from which the first printed sheet 2*c*" is conveyed further to the cross folding.

The guide plane 9, shown extending horizontally herein, can naturally also extend vertically or at any optional angle in space, thus permitting a plurality of structural options, depending on the concrete use conditions. Even though up to now and henceforth only a single printed sheet 2, 3 has been described and will be described in the Figures for reasons of simplicity, this refers respectively to at least one printed sheet 2, 3, meaning either a single printed sheet 2, 3 or several sheets placed one above the other.

Two folding rolls 12 are arranged above the guide plane 9 on a first side 11 of the cross-folding device 6. These are respectively provided with a rotational axis 13 and between them form a folding gap 14 for folding the printed sheets 2 crosswise along a prepared folding line 15 (FIG. 3) or also along a non-prepared folding line. The rotational axes 13 of the folding rolls 12 are oriented substantially parallel to each other as well as parallel to the guide plane 9. Based on known order data or currently acquired data, the folding gap 14 can be adjusted manually or motorized, depending on the material thickness and the number of first printed sheets 2 to be cross folded, wherein the two folding rolls 12 can have identical or different diameters. To prevent, for example, a contact between the printed sheet and the downstream folding roll 12 and thus the stopping of the printed sheet, the diameter of the downstream folding roll 12 can be smaller than the diameter of the upstream folding roll 12.

A compressed-air device 17 for the cross-folding device 6 is arranged on a second side 16 of the cross-folding device 6, which is opposite the first side 11 of the guide plane 9, and thus below the guide plane 9. The compressed-air device 17, oriented substantially parallel to the rotational axes 13 of the folding rolls 12, is provided with at least one, but preferably several, exit openings 18 (FIGS. 2, 3) focused onto the folding gap 14 for blowing compressed air 19. The compressed air device is connected via a compressed-air line 20 to a compressed-air source 21 which, in turn, is connected via a control line 22 to a control unit 23 of the apparatus 1. The compressed-air device 17 further comprises a first control element 24, e.g. embodied as magnetic valve, for admitting with compressed air 19 a first printed sheet 2, here the first printed sheet 2*c*" in a folding position 25, as shown in FIG. 3, wherein the first printed sheet 2 in the folding position 25 is positioned flat between the two folding rolls 12 and the compressed-air device 17, or also for changing the time interval for admitting the at least one exit opening 18 with compressed air.

Figure 3:
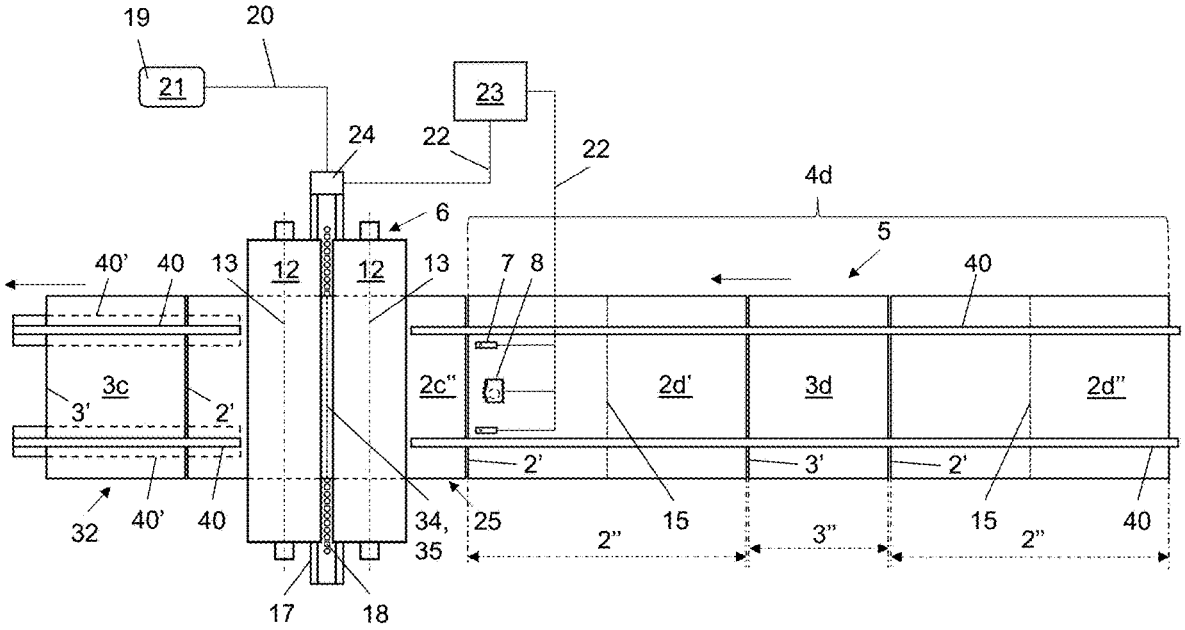
FIG. 3 A schematic view from above onto the cross-folding device according to FIGS. 1 and 2, wherein a first printed sheet is located in a folding position in the cross-folding device, meaning between the folding rolls and the compressed-air device.

Also shown in FIG. 3 are the printed sheets 2*d*', 3*d*, 2*d*" belonging to a partial book block 4*d* to be formed downstream of the apparatus 1 which, in the same way as the other first printed sheets 2, have respectively a first sheet length 2" prior to the cross-folding and/or have respectively a second sheet length 3" as for the other second printed sheets 3. The sheet lengths 2", 3" of associated printed sheets 2, 3 differ such that the first sheet length 2" is substantially twice as long as the second sheet length 3". Even though it is shown in FIGS. 1, 2, 7 and 8 in addition to FIG. 3 that a non-folded second printed sheet 3 is inserted between two cross-folded first printed sheets 2 or is intended to be inserted therein, it is in principle possible to create in the apparatus 1 an optional sequence of cross-folded first printed sheets 2 and non-folded second printed sheets 3.

The compressed air device 17 for this example can comprise a second control element 26, e.g. embodied as slider or valve, for changing the cross section of the at least one exit opening 18, not shown herein, as well as a third control element 27 that can embodied as pressure-reducing valve, which is arranged in the compressed-air line 20 for changing the pressure of the compressed air 19 to be supplied to the at least one exit opening 18 (FIG. 2). The second control element 26 here can be connected to a slidable diaphragm provided with at least one recess, which is also not shown herein. By correspondingly moving this diaphragm, the at least one exit opening 18 is uncovered partially or totally or is completely covered, meaning the cross-sectional surface is changed. Of course, other suitable means can also be used for changing this cross-sectional surface. The control elements 24, 26, 27 are connected via separate control lines 22 to the control unit 23.

A second transport segment 28 for cross-folded first printed sheets 2 starts at the first segment point 10 and extends through the folding rolls 12 of the cross-folding device 6 to a second segment point 29. A first diverter 30 is arranged along the second transport segment 28 for moving a cross-folded first printed sheet 2*x* to a first container 31, e.g. embodied for holding samples (FIG. 1).

Adjoining the first transport segment 5 is a third transport segment 32 for non-folded second printed sheets 3, which also starts at the first segment point 10. The first segment point 10 is therefore a joint segment point for the first transport segment 5 ending therein and the second and third transport segments 28 and 32 which start at that point. The third transport segment 32 meets the second transport segment 28 at the second segment point 29 and ends there. Its length exceeds the length of the second transport segment 28. The third transport segment 32 furthermore comprises for the length adjustment a device 33 which, as shown in FIG. 1, comprises a sliding cylinder 33*a* having a cylinder rod 33*b*, as well as a guide roller 33*c* attached thereto that interacts with the third transport segment 32. Of course, a different suitable arrangement can also be used for the length adjustment of the third transport segment 32. The first segment point 10 is positioned on a line of intersection 34 between the guide plane 9 and a folding plane 35 (FIGS. 2 and 3) that extends through the folding gap 14 and through the at least one exit opening 18 of the compressed air device 17.

At the second segment point 29, a fourth transport segment 36 adjoins the second and third transport segments 28, 32 (FIG. 1). The second segment point 29 thus forms a joint segment point for the second, third and fourth transport segments 28, 32 and 36. With a second diverter 37, arranged along the fourth transport segment 36, it is possible to divert cross-folded first printed sheets 2 and non-folded second printed sheets 3, in this case the printed sheets 2*z* and 3*y* but also waste paper, and move these to a second receiving container 38. Separate light barriers 7' can also be arranged in front of the first and the second diverters 30, 37, so that the respective diverter 30, 37 can be switched precisely.

According to the representation in FIG. 1, a sequence of a first printed sheet 2 to be folded, followed by a second printed sheet 3 not to be folded, followed by another first printed sheet 2 to be folded has been supplied to the apparatus 1 several times in succession. In the downstream region of the fourth transport segment 36 of the apparatus 1, these are the non-folded second printed sheet 3*a* and the cross-folded first printed sheet 2*a*" which, jointly with a preceding, non-depicted cross-folded first printed sheet 2*a*', were intended to form the first partial book block 4*a*. For this, the printed sheets 2*a*', 3*a*, 2*a*" were conveyed initially in this sequence with the first transport segment 5 to the folding position 25 (FIG. 3), in which they were positioned flat between the folding rolls 12 and the compressed air device 17. Starting with this folding position 25, the first printed sheets 2*a*', 2*a*" to be cross folded were respectively admitted with a compressed air blast 19' from the at least one exit opening 18 in the compressed air device 17, as shown in FIG. 2 for the first printed sheet 2*c*". Owing to this compressed air blast 19', the printed sheets 2*a*', 2*a*" to be folded crosswise were respectively pressed with the center region between the folding rolls 12, in the process were diverted to the second transport segment 28, and were subsequently cross-folded with the aid of the folding rolls 12. The compressed air blast 19' was triggered in that the control unit 23 has transmitted a corresponding control signal via the control line 22 to the first control element 24, thus providing compressed air 19 from the compressed air source 21. In contrast, such a compressed air blast 19' was suppressed for the second printed sheet 3*a*, not to be folded, which has meanwhile been positioned in the folding position 25, so that this printed sheet was diverted and has bypassed the folding rolls 12 and was conveyed to the third transport segment 32. The decision, whether such a compressed air blast 19' is triggered or suppressed, depends on the production orders that are deposited within the control unit 23. As the control unit 23 according to said production orders knows the number and the sequence of the first printed sheets 2 to be cross-folded and of the second printed sheets 3 not to be folded that are intended for the respective partial book blocks 4*a*, 4*b*, 4*c*, 4*d*, etc., an exact point in time for a respective pulse for triggering or suppressing the compressed air blast 19' is determined with the at least one light barrier 7 and/or image-detecting device 8 arranged immediately before the cross-folding device 6, In case there is an image-detecting device 8, arranged additionally or alternatively to the at least one light barrier 7, the printed sheets 2, 3 can be identified advantageously and definitely by means of respective identification features, immediately before the cross-folding device 6.

By conveying the non-folded second printed sheet 3*a* further to the third transport segment 32, a first partial gap 39*a* was generated in the second transport segment 28, upstream of the cross-folded first printed sheet 2*a*', which is shown in FIG. 1 in the same way with a curved bracket upstream of the first printed sheet 2*c*'. This first partial gap 39*a* was followed by a second partial gap 39*b*, generated downstream of the first printed sheet 2*a*" as a result of its folding operation, also shown in FIG. 1 with a curved bracket, downstream of the first printed sheet 2*c*". The second partial gap 39*b* develops respectively because the first printed sheets to be cross folded, prior to reaching the folding rolls 12, initially enter with their front edge 2' (FIGS. 2, 3) and nearly extend to the center of the third transport segment 32 before they are deflected into the folding rolls 12 by the effect of the compressed air blast 19' hitting the sheet center, thus halving the original sheet length 2" (see FIG. 3). The two partial gaps 39*a*, 39*b* had formed a joint insertion gap 39 between the two successively following first printed sheets 2*a*', 2*a*", as shown in FIG. 1, with the corresponding insertion gap 39, also shown with curved bracket, between the first printed sheet 2*c*' currently positioned on the second transport segment 28 and the following printed sheet 2*c*" that is in the process of being folded. Following its transport on the third transport segment 32, the non-folded second printed sheet 3*a* was inserted precisely into this insertion gap between the cross-folded first printed sheets 2*a*' 2*a*", in the region of the second segment point 29. The above-described operational sequence was identical to the one used for the printed sheets 2*b*', 3*b*, 3*b*" intended for the second partial book block 4*b*, wherein FIG. 1 shows precisely the situation in which the non-folded second printed sheet 3*b* has been inserted into the existing gap 39, between the two cross-folded first printed sheets 2*b*' and 2*b*". If printed sheets 2, 3 with at least one different format are processed for a following production order, as compared to a previous production order, the third transport segment 32 can be extended or shortened with the aid of the device 33, such that the non-folded second printed sheet 3 being conveyed on this transport segment 32 can advantageously also be inserted into the center of the gap 39 between the associated, cross-folded first printed sheets 2.

Figure 6:
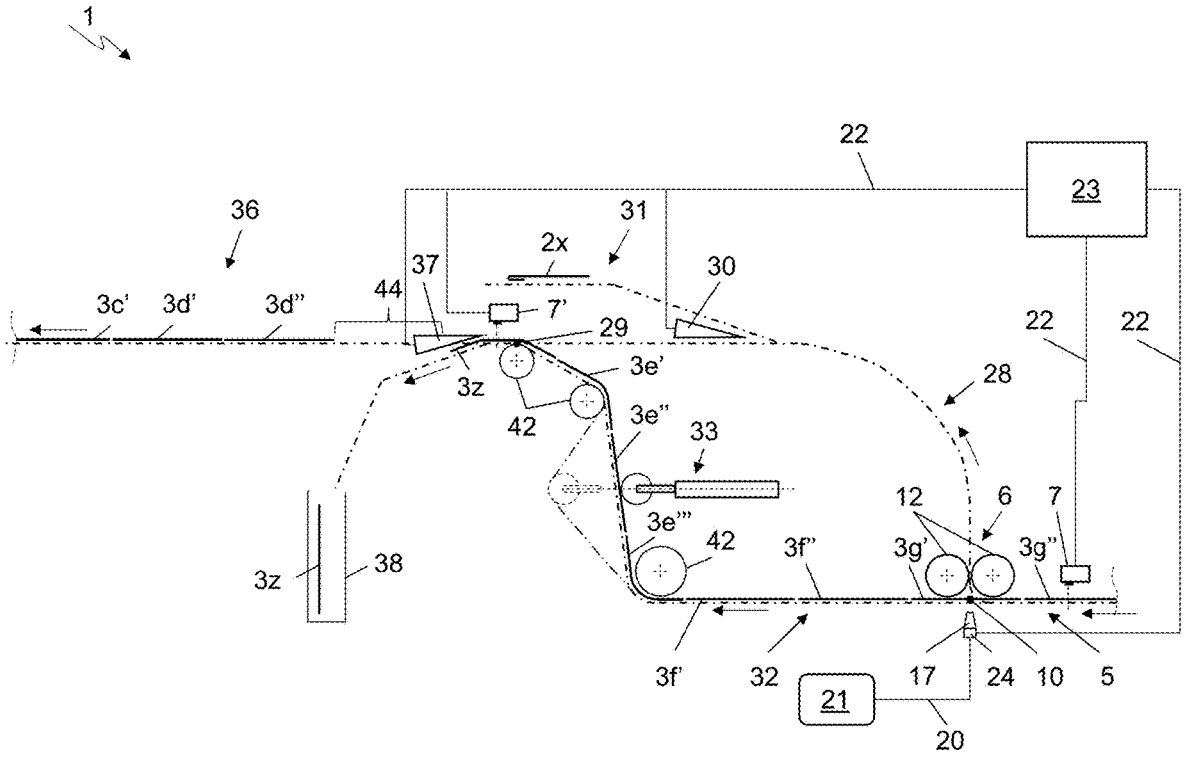
FIG. 6 A second snapshot of the apparatus according to FIG. 1, taken at a later time as compared to FIG. 5.
Figure 7:
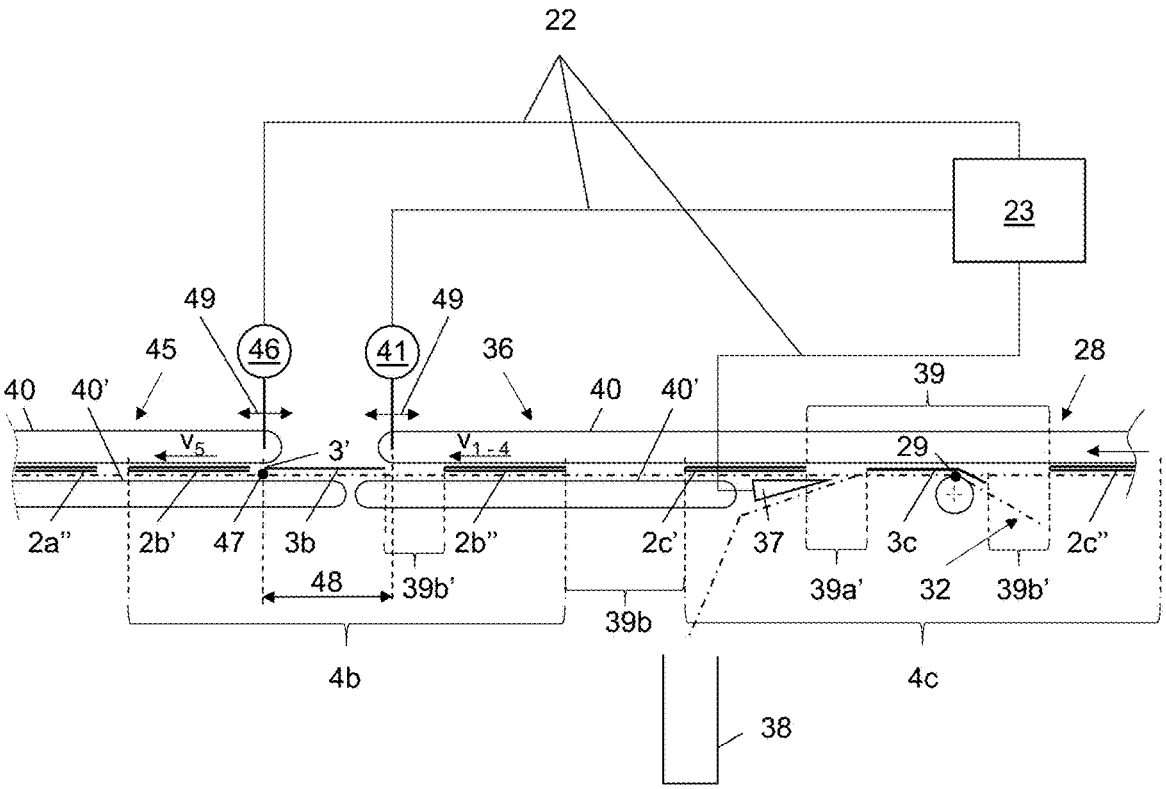
FIG. 7 An enlarged schematic representation, showing the downstream region of the apparatus in FIG. 1, in a second embodiment with an additional, fifth transport segment.
Figure 8:
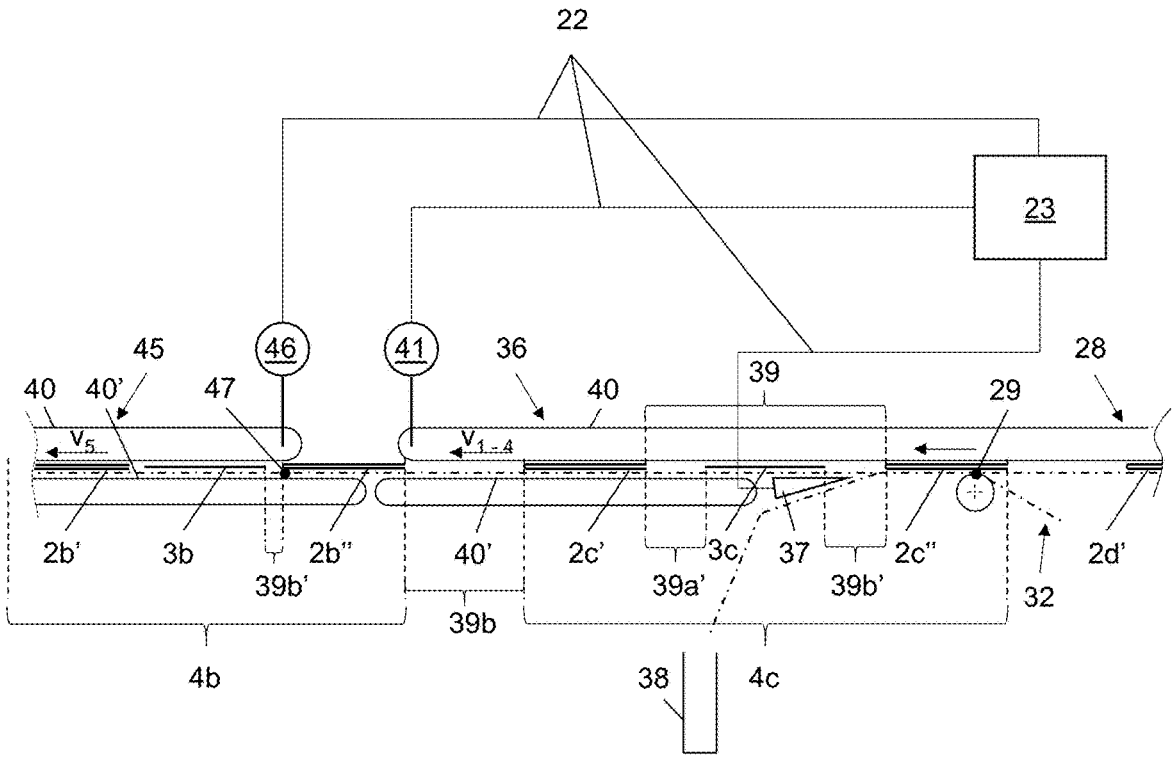
FIG. 8 A representation according to FIG. 7 but showing a somewhat later processing instant.

The printed sheets 2, 3 are transported on all transport segments 5, 28, 32, 36 with the aid of the conveying elements 40, 40', shown in FIG. 3, which are arranged on both sides of the printed sheets 2, 3 and are embodied, for example, as transport belts or bands. In FIG. 3, the conveying elements 40, 40' are arranged below as well as above the printed sheets to be transported since the transport segments 5, 32, shown therein, only extend horizontally. With transport segments arranged vertical or at an angle, e.g. as is the case in the upstream region of the second transport segment 28 and the downstream region of the third transport segment 32, the conveying elements 40, 40' can also be arranged on the side. In FIG. 3, the lower conveying elements 40' are shown only on the third transport segment 32 for reasons of simplicity. Similar conveying elements 40, 40' are also shown in FIGS. 7 and 8 and partially also in FIG. 2. The conveying elements 40, 40' for the transport segments 5, 28, 32, 36 are operated at the same speed $v_{1-4}$ and are provided with a joint drive 41, shown in FIGS. 7 and 8. Of course, the transport segments 5, 28, 32, 36 can also be provided with separate drives. Several deflection and/or tension rolls 42 are shown in FIG. 1 and in FIGS. 4 to 6 for the conveying elements 40, 40' in the third transport segment 32, which are not shown further in the Figures. Similar deflection and/or tension rolls for the conveying elements can, of course, also be arranged in the second transport segment 28.

Figure 4:
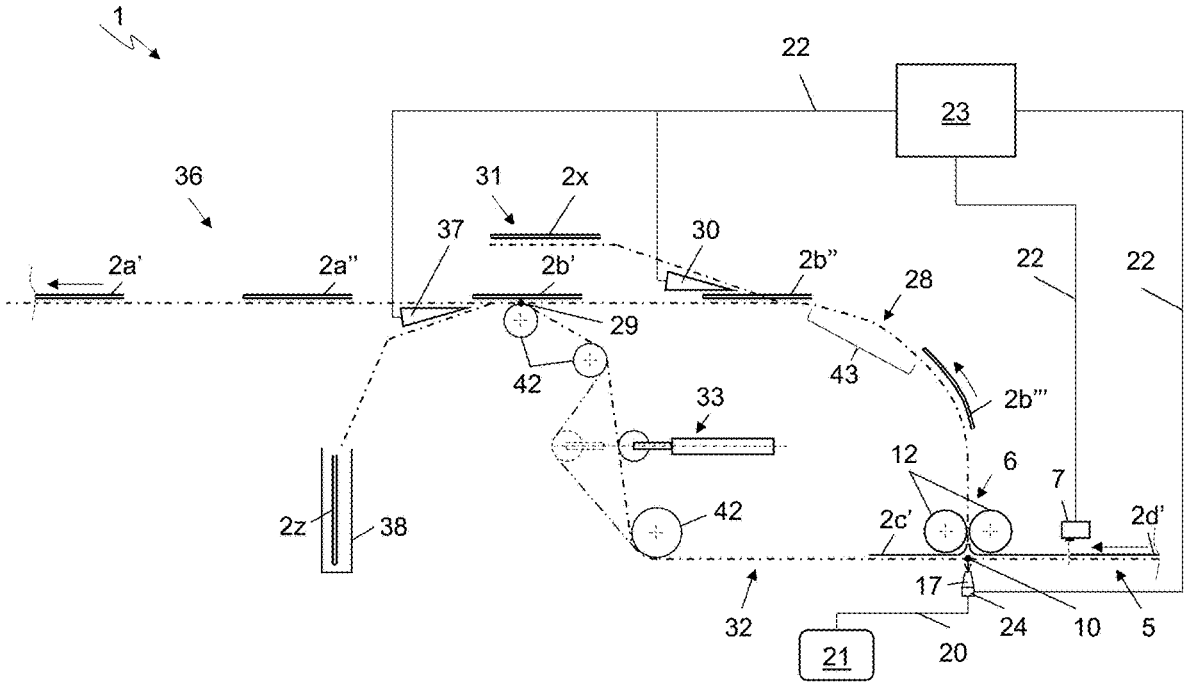
FIG. 4 A schematic view from the side of the apparatus shown in FIG. 1, wherein all printed sheets have already been folded and/or are in the process of being folded.

According to FIG. 4, the apparatus 1 can also be used for processing only first printed sheets 2 to be folded. As a result, non-folded second printed sheets 3 need not be removed via the transport segment 32, meaning it remains inactive. Starting with an order having a sequence of partial book blocks with two, three and one first printed sheet 2 to be cross folded, for example, FIG. 4 shows from left to right the already cross-folded first printed sheets 2*a*', 2*a*", 2*b*', 2*b*", 2*b*'", a first printed sheet 2*c*' that is being raised in the center via a compressed air blast 19' from the folding position in the direction of the folding rolls 12, as well as an additional first printed sheet 2*d*' that must be cross-folded in accordance with a following production order. With this operating mode for the apparatus 1, a compressed air blast 19' is always triggered when a first printed sheet 2 is in the folding position 25. As a result of the folding operation, a first gap 43 is respectively formed between the cross-folded first printed sheets 2, shown with curved bracket, which permits a non-problematic adding of the two diverters 30, 37 so that cross-folded first printed sheets 2 can be removed, if necessary, for the purpose of having a sample, or that defective cross-folded first printed sheets 2*x*, 2*z* can be removed, as shown in FIG. 4. The first printed sheets 2 which are not removed can be processed again downstream of the apparatus 1, for example to form partial book blocks that are not shown herein.

Figure 5:
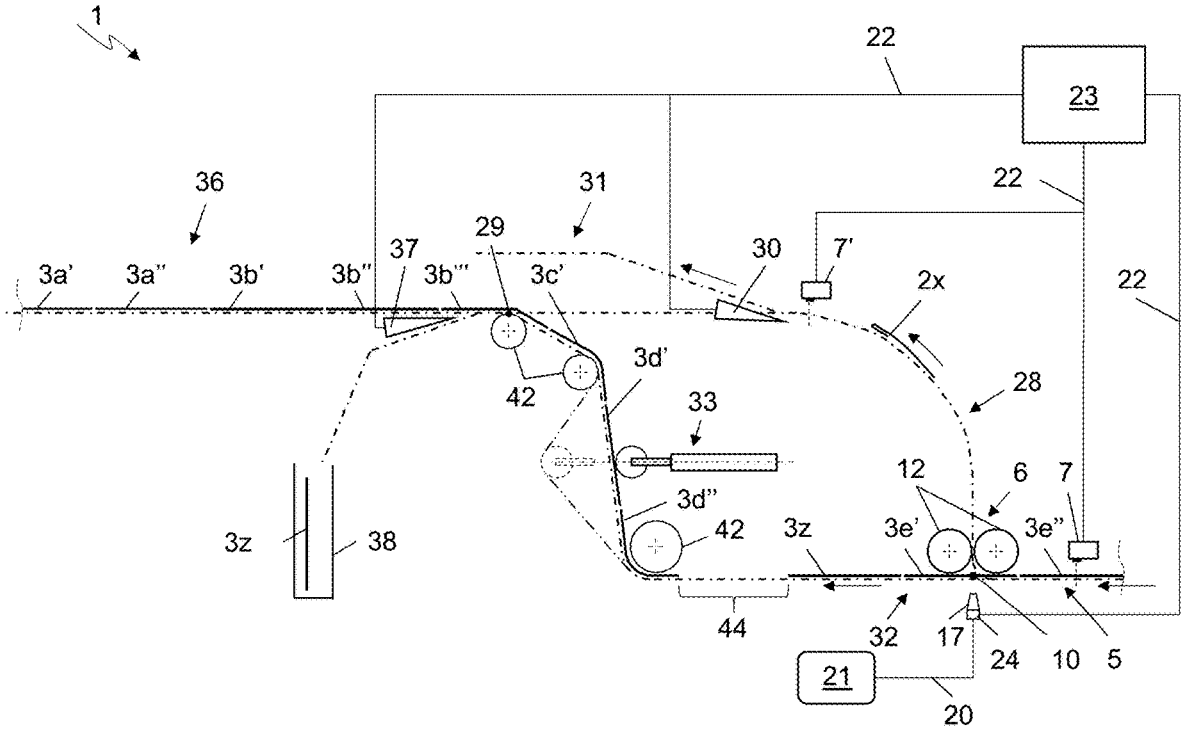
FIG. 5 A first snapshot of the apparatus according to FIG. 1, wherein all printed sheets to be processed further, e.g. for the later forming of partial book blocks, bypass the folding rolls and thus are not folded.

FIG. 5 presents another operating mode for the apparatus, for which all printed sheets intended for the further processing, for example to be used for forming partial book blocks later on which are also not shown herein, meaning the second printed sheets 3 shown here as printed sheets 3*a*', 3*a*", 3*b*', 3*b*", 3*b*'", 3*c*', 3*d*', 3*d*", 3*e*', 3*e*", bypass the folding rolls 12 and are thus not folded. For this, the compressed air blast 19' is respectively suppressed for the second printed sheets 3 positioned in the folding position 25—as is the case at present for the second printed sheets 3*e*'—so that the second printed sheets 3 can thus be conveyed by the third transport segment 32. In that case, the second printed sheets 3 are transported so-to-speak without any gap through the complete apparatus 1. However, defective second printed sheets 3 should still be removed, if necessary, as has happened already with the second printed sheet set 3*z* located in the receiving container 38. To remove another second printed sheet that is still located on the third transport segment 32, via the second diverter 37, a first printed sheet 2*x* that precedes this second printed sheet 3*z* and is located in the folding position 25 is deflected with the aid of a compressed air blast 19' in the direction of the folding rolls 12 and thus into the second transport segment 28. In this way, a second removal gap 44 is formed in the third transport segment 32, between the preceding second printed sheet 3*d*" and the additional second printed sheet 3*z* to be removed later to the second receiving container 38. FIG. 5 shows a first snapshot where this second removal gap 44 in the third transport segment 32 has already moved somewhat in the direction of the second segment point 29. FIG. 6, in contrast, shows a later snapshot depicting the start of the removal of the additional second printed sheet 3*z*, following the earlier detection of said printed sheet by the additional light barrier 7' and the corresponding switching of the second diverter 37. In this snapshot, the second removal gap 44 used previously for switching the second diverter 37 is, as shown, already located downstream of the second removal deflector 37. The additional second printed sheets 3*e*', 3*e*", 3*e*'", 3*f*', 3*f*", 3*g*' and 3*g*" follow in upstream direction.

The first printed sheet 2*x* which, according to FIG. 5, is located on the second transport segment 28 and used for switching the second diverter 37 and thus for removing the additional second printed sheet 3*z*, was previously folded crosswise between the folding rolls 12. However, since this first printed sheet 2*x* will not be a component of the later partial book block and is earmarked for removal to the receiving container 31, it can be folded crosswise at any optional location. Also, the switching of the first diverter 30, following the detection of the first printed sheet 2*x* with the additional light barrier 7', proves to be non-problematic since no other first printed sheet 2 directly precedes the first printed sheet 2*x*. FIG. 6 shows the first removed printed sheet 2*x* which is already located in the first receiving container 31. Through a corresponding earlier triggering of the compressed air blast 19', focused onto the first printed sheet 2*x*, meaning prior to reaching its folding position 25, this first printed sheet 2*x* can also be deflected in the direction of the folding rolls 12, such that it passes non-folded through these rolls and later on can advantageously be used again. When starting up or shutting down the apparatus 1 and/or an inline digital printing press installed upstream of the apparatus, a first printed sheet 2*x* of this type is anyway part of the printing waste and thus is removed from the first receiving container 31.

According to a second exemplary embodiment (FIGS. 7, 8) of the apparatus 1, a fifth transport segment 45 adjoins the fourth transport segment 36 in downstream direction, at a distance thereto, which serves to supply the printed sheets 2, 3 to a downstream arranged post-processing machine, not shown herein, for example a machine for forming partial book blocks 4*a*, 4*b*, 4*c*, 4*d* etc. As shown in FIG. 7, the printed sheets 2*a*" and 2*b*' are being conveyed on the fifth transport segment 45. The fifth transport segment 45 is also provided with conveying elements 40, 40', comprising a separate drive 46, as compared to the joint drive 41 for the transport segments 5, 28, 32, 36. Owing to this separate drive 46, the fifth transport segment 45 can be operated with a speed $v_5$ that differs from the speed $v_{1-4}$ of the other four transport segments 5, 28, 32, 36.

For example, the speed $v_5$ is selected to be slower than the speed $v_{1-4}$ if existing partial gaps must be minimized, e.g. the partial gap 39*b* shown in FIG. 7 between the two successively following, cross-folded first printed sheets 2*b*" and 2*c*'. This also applies to minimizing residual partial gaps remaining of the previous partial gaps 39*a*, 39*b*. A first residual gap 39*a*' can be seen, for example, downstream of the non-folded, second printed sheet 3*c*, just inserted into the previously generated gap 39 between the cross-folded first printed sheet 2*c*' and 2*c*", and such a second residual gap 39*b*' that forms downstream of the cross-folded first printed sheet 2*c*". A further second residual gap 39*b*' is located in the downstream region of the fourth transport segment 36. Of course, depending on the post-processing operation downstream of the apparatus 1, the speed $v_5$ can also be higher than the speed $v_{1-4}$, for example if as shown in FIGS. 5 and 6 only non-folded second printed sheets 3 are conveyed on the third transport segment 32 for the apparatus 1 and if corresponding gaps are needed between the second printed sheets 3 for the further processing.

During the transfer of a printed sheet 2, 3 from the fourth transport segment 36 to the fifth transport segment 45, as shown in FIG. 7 for the non-folded second printed sheet 3*b*, this sheet is initially conveyed by the conveying elements 40, 40' of the fourth transport segment 36 until it is no longer clamped in along its back edge by these conveying elements 40, 40'. FIG. 7 shows precisely the following moment in which the front edge 3' of the non-folded second printed sheet 3*b* is first clamped in by the conveying elements 40, 40' of the fifth transport segment 45 and the transport segment 45 thus takes over the transport. The fifth transport segment 45 starts at a third segment point 47, at a distance to the transport segment 36, where a printed sheet 2, 3 is first admitted with a conveying pulse coming from the fifth transport segment 45. Since the respective printed sheet 2, 3 is only clamped in by the conveying elements 40, 40' of one of the two transport segments 36, 45 during the transfer, it is possible to effectively avoid a bunching, crumpling or even destroying of these printed sheets 2, 3.

Since the size of the spacing 48 between the two transport segments 36, 45 is thus decisive for the correct transfer of the respective printed sheet 2, 3 and because printed sheets 3 with different formats can be processed, depending on the production order, at least one of the two transport segments 36, 45, but advantageously both, are provided with an adjustment member 49 for changing the spacing 48. The adjustment member or members 49 can be operated manually or, advantageously, also motorized.

FIG. 8 shows a somewhat later snapshot, as compared to FIG. 7, where the cross-folded first printed sheet 2*b*" which follows the non-folded printed sheet 3*b* has just been released by the conveying elements 40, 40' of the fourth transport segment 36 and has been clamped in along its front edge at the third segment point 47 by the conveying elements 40, 40' of the fifth transport segment 45. As a result, the first cross-folded printed sheet 2*b*" has been transferred to the fifth transport segment 45 and its conveying elements 40, 40' take over the additional transport.

As a result of the speed $v_5$ of the fifth transport segment 45 being lower than the speed $v_{1-4}$ of the transport segments 5, 28, 32, 36, the second residual gap 39*b*' still existing in FIG. 7 between the printed sheets 3*b* and 2*b*" in the downstream region of the fourth transport segment 36, has already been minimized in FIG. 8. Since the speed $v_5$ of the first printed sheet 2*b*" transported on the fifth transport segment 45 is lower than the speed of the following printed sheet 2*c*' still conveyed on the fourth transport segment 36, the second partial gap 39*b* between these first printed sheets 2*b*", 2*c*', which has meanwhile moved to the downstream region of the fourth transport segment 36, will soon be minimized, wherein this also applies later on in the same way to the two residual gaps 39*a*', 39*b*' and all following gaps between the printed sheets.

Triggered by the control unit 23, the separate drive 46 can be operated at different speeds, so that successively following, different speeds $v_5$ can be realized for the fifth transport segment 45. In this way, the remaining gaps between printed sheets 2, 3 conveyed on the fifth transport segment 45 can, if necessary, have a uniform length.

Of course, the connection of the control unit 23 for the apparatus 1 to the control elements 24, 26, 27 of the cross-folding device 6, illustrated herein respectively by a control line 22 in the form of a wire connection, with the light barriers 7, 7', the image-detecting device 8, the two diverters 30, 37, and the drives 41, 46 for the transport segments 5, 28, 32, 36, 45 can also be embodied wireless. Naturally, additional sensors, drives or other devices such as the length-adjustment members can also be connected to the control unit 23, as shown with a dashed line in FIG. 1.

It will be understood that the above description of the present invention is susceptible to various modifications, changes and adaptations, and that the same are intended to be comprehended within the meaning and range of equivalents of the appended claims.

The invention claimed is:

1. An apparatus for an optional cross folding of successively following, sequentially printed sheets, comprising:

a first transport segment on which the sequentially printed, first printed sheets to be cross-folded and second printed sheets not to be folded, are transported successively in a guide plane and are respectively made available in a folding position;

at least two folding rolls arranged on a first side of the guide plane which respectively include a rotational axis and together define a folding gap therebetween for cross folding the first printed sheets, wherein the rotational axes are oriented substantially parallel to each other and parallel to the guide plane;

a compressed air device oriented substantially parallel to the rotational axes of the folding rolls on a second side of the guide plane and arranged opposite the first side of the guide plane and in a region of the folding gap, wherein the compressed-air device is connected to a compressed air source and a control unit, and includes at least one exit opening for focusing compressed air onto the folding gap;

a second transport segment for cross-folded first printed sheets and a third transport segment for non-folded second printed sheets, wherein the first, second and third transport segments have a joint first segment point at which the first transport segment ends and the second and third transport segments start, wherein the joint first segment point is positioned on a line of intersection between the guide plane and a folding plane that extends through the at least one exit opening of the compressed air device; wherein the compressed air device includes a first control element connected to the control unit for optionally triggering or suppressing a compressed air blast coming from the at least one exit opening of the compressed air device, such that respectively starting with the folding position, one of the first printed sheets is moved for the folding operation into the second transport segment or one of the second printed sheets bypasses the folding operation and is moved to the third transport segment;

wherein the third transport segment empties downstream of the folding rolls into the second transport segment, at a joint second segment point; and further including a fourth transport segment downstream of the joint second segment point that adjoins the second and third transport segments at the joint second segment point;

wherein the third transport segment is longer than the second transport segment or can be operated at a slower speed than the second transport segment such that a first sequence of printed sheets, following successively on the first transport segment, is identical to a second sequence of first cross-folded sheets and second non-folded printed sheets following successively on the fourth transport segment.

2. The apparatus according to claim 1, wherein the third transport segment is essentially embodied longer than the second transport segment by half a sheet length of a first printed sheet to be cross-folded.

3. The apparatus according to claim 1, further including a mechanism for adjusting the length of the third transport segment arranged in a region of the third transport segment.

4. The apparatus according to claim 1, further including at least one of a light barrier and an image-detecting device, arranged in a region of the first transport segment and connected to the control unit, for detecting respective front edges of the first and second printed sheets transported on the first transport segment.

5. The apparatus according to claim 1, further including a first diverter arranged in the second transport segment and a first receiving device downstream of the first diverter arranged for receiving selected ones of the cross-folded first printed sheets.

6. The apparatus according to claim 1, wherein the folding rolls are arranged above the guide plane and the compressed air device is arranged below the guide plane.

7. The apparatus according to claim 1, further including a second diverter arranged in the fourth transport segment and a second receiving container arranged downstream of the second diverter for receiving selected ones of the cross-folded first printed sheets and the non-folded second printed sheets.

8. The apparatus according to claim 1, further including a joint drive connected to the control unit for the first, second, third and fourth transport segments.

9. The apparatus according to claim 1, further including a fifth transport segment downstream of the fourth transport segment and starting at a distance from the fourth transport segment, wherein the fifth transport segment includes a separate drive connected to the control unit to permit the fifth transport segment to operate at a different speed than the fourth transport segment.

10. The apparatus according to claim 9, further including an adjustment member for adjusting a spacing between the fourth and fifth transport segments.

11. The apparatus according to claim 1, further including at least one additional control element connected to the compressed air source and the control unit for changing at least one of a cross-sectional surface of the at least one exit opening of the compressed air device and the pressure of the compressed air to be supplied to the exit opening of the compressed air device.

12. A method for optionally cross-folding successively following, sequentially printed sheets, comprising:

conveying at least a first printed sheet and a second printed sheet successively in a guide plane of a first transport segment for respectively making available the first and second printed sheets in a folding position;

cross-folding the available first printed sheet along a folding line on a first side of the guide plane in a folding gap between at least two rotating folding rolls having separate rotating axes;

prior to the cross-folding and starting from a second side of the guide plane, located opposite a first side, triggering a compressed air blast from at least one exit opening of a compressed air device which is coupled to a compressed air source and a control unit, focusing the compressed air blast in a region of the folding gap onto the first printed sheet made available in the folding position, transporting the available first printed sheet under effect of the compressed air blast and the rotating folding rolls from the guide plane to a second transport segment and, following the cross-folding, further transporting the cross-folded first printed sheet on the second transport segment;

suppressing a compressed air blast that is focused onto the second printed sheet made available in the folding position and conveying the consequently non-folded second printed sheet to a third transport segment;

conveying the non-folded second printed sheet that is moved to the third transport segment for a longer interval on the third transport segment than the cross-folded first printed sheet that is conveyed on the second transport segment; and following the cross-folded first printed sheet, moving the non-folded second printed sheet into a fourth transport segment that adjoins the second transport segment such that the sequence of the sequentially following printed sheets on the first transport segment is established for the cross-folded first printed sheets and the non-folded second printed sheets on the fourth transport segment.

13. The method according to claim 12, further including correspondingly changing the length of the third transport segment for a following production order with first and second printed sheets having at least one different format as compared to a previous production order.

14. The method according to claim 12, further including automatically detecting a front edge of the first and second printed sheets transported on the first transport segment and that based thereon, transmitting a corresponding information to the control unit, generating with the control unit a respective pulse at an instant of time of an optional triggering or suppressing of a compressed air blast from the at least one exit opening of the compressed air device which is focused on a respective one of the first and second printed sheets that has meanwhile moved to the folding position, and further transmitting the pulse to a first control element that is connected to the compressed air device and the compressed air source.

15. The method according to claim 12, further including removing cross-folded first printed sheets for control purposes from the second transport segment.

16. The method according to claim 12, further including removing at least one of defective cross-folded first printed sheets and non-folded second printed sheets from the fourth transport segment.

17. The method according to claim 12, further including transferring the cross-folded first printed sheets and the non-folded second printed sheets downstream of the fourth transport segment to a fifth transport segment, operated separately and at a distance from the fourth segment, and conveying the cross-folded first printed sheets and the non-folded second printed sheets on the fifth transport segment with a different speed than on the fourth transport segment.

18. The method according to claim 17, further including, for a following production order where at least one printed sheet has a different format than for the preceding production order, correspondingly changing a distance between the fourth transport segment and the fifth transport segment.

19. The method according to claim 12, further including the following steps:

forming a first partial gap in the second transport segment upstream of a cross-folded first printed sheet, during a further conveying of a non-folded second printed sheet into the third transport segment, forming a second partial gap during a cross-folding of an additional first printed sheet belonging to the same production order, downstream of the additional first printed sheet and adjacent to the first partial gap, wherein the two partial gaps jointly form an insertion gap, and inserting the non-folded second printed sheet conveyed on the third transport segment into the insertion gap in a region of the fourth transport segment between the cross-folded first printed sheet and the additional cross-folded first printed sheet.

20. The method according to claim 19, further including making available successively in the folding position, one of the first printed sheets with a first sheet length, one of the second printed sheets with a second sheet length, and an additional first printed sheet with the first sheet length, wherein for first and second printed sheets of the same production order, the first sheet length is essentially twice as long as the second sheet length.

* * * * *